United States Patent [19]

Fischer

[11] 4,124,048

[45] Nov. 7, 1978

[54] LEAD SHARPENER

[75] Inventor: Ernst Fischer, Bräuningshof, Fed. Rep. of Germany

[73] Assignee: Möbius & Ruppert KG, Erlangen, Fed. Rep. of Germany

[21] Appl. No.: 808,671

[22] Filed: Jun. 21, 1977

[30] Foreign Application Priority Data

Jul. 2, 1976 [DE] Fed. Rep. of Germany ..... 2629777

[51] Int. Cl.[2] ..... B43L 23/00

[52] U.S. Cl. ..... 144/28.2; 144/28.11; 145/3.31; 145/3.5

[58] Field of Search ..... 144/28.1, 28.11, 28.2; 145/3.3, 3.31, 3.32, 3.5, 3.9

[56] References Cited

U.S. PATENT DOCUMENTS

| | | | |
|---|---|---|---|
| 1,248,733 | 12/1917 | Simmons | 144/28.1 |
| 2,613,645 | 10/1952 | Kameniczky | 144/28.11 |
| 2,926,632 | 3/1960 | Cunningham | 144/28.1 |
| 3,042,003 | 7/1962 | Cayo | 144/28.1 |
| 3,398,773 | 8/1968 | Dahle | 144/28.1 |
| 3,698,456 | 10/1972 | Cho | 144/28.11 |

FOREIGN PATENT DOCUMENTS

| | | | |
|---|---|---|---|
| 2,419,115 | 10/1975 | Fed. Rep. of Germany | 144/28.2 |

*Primary Examiner*—Othell M. Simpson
*Assistant Examiner*—W. D. Bray

[57] ABSTRACT

A lead sharpener comprises a housing formed by relatively rotatable lower and upper housing portions containing a milling cutter of which the operating face extends at an acute angle to the longitudinal axis of a guide passage through which the lead that is to be sharpened is introduced. To enable the sharpened point of the lead to have a selected configuration, the guide passage is provided in an insert member which is rotatable in a hole provided in the upper housing portion, the arrangement being such that the longitudinal axis of the guide passage does not coincide with the rotary axis of the insert member whereby, upon rotation of the insert member, the spacing and possibly also the angle between the longitudinal axis of the guide passage and the operating face of the milling cutter are changed.

7 Claims, 7 Drawing Figures

LEAD SHARPENER

The invention relates to a lead sharpener comprising a housing formed by an upper and lower housing portion which are rotatable relatively to one another, the housing containing a guide passage for introducing the lead to be sharpened and having a longitudinal axis that is eccentric with respect to the rotary axis of the housing portions, the operating face of a milling cutter in the housing including an acute angle with the longitudinal axis of the guide passage.

In explanation, the 'lead' here in question is the graphite rod that is usually fitted in a holder to form a writing or drawing implement.

A lead sharpener of the kind in question is used in that, after the lead has been projected from the holder to a certain extent, the holder is offered to the sharpener so that the lead is introduced into the guide passage, whereupon the lead holder is held to the upper housing portion and turned therewith about the axis of the milling cutter. During this rotation, the tip of the lead is in contact with the cutting edges of the milling cutter and these cutting edges shave the lead to sharpen it to a point. For this purpose, it is essential that the longitudinal axis of the lead and the operating face of the milling cutter should include an acute angle between each other. If the guide passage for the lead is provided in the upper housing portion to extend perpendicular or parallel to the axis of the milling cutter, this acute angle is brought about by making the operating face of the milling cutter frustoconical. Alternatively, the operating face of the milling cutter can be cylindrical, in which case the guide passage for the lead must be inclined to the axis of the milling cutter. For production reasons, the present invention to be described in greater detail hereinafter preferably concerns sharpeners employing cylindrical milling cutters.

Lead sharpeners of the kind here in question have the disadvantage that is is not readily possible to sharpen the point of the lead in a manner such as to meet particular requirements. In particular, they do not make provision for the stepless adjustment of the fineness and/or angle of the point of the lead. To bring about an improvement in this respect, the invention provides for the guide passage for the lead to be formed in such a way in an insert member that is rotatable in a hole of the upper housing portion that the longitudinal axis of the guide passage assumes a different spatial position from that of the rotary axis of the insert member whereby, upon rotation of the insert member, a spacing defined between the longitudinal axis of the guide passage and the operating face of the milling cutter is varied.

If the cone angle of the sharpened point of the lead is always to be the same and it is only the fineness or slenderness of the tip of the lead that is to be steplessly variable, the rotary axis of the insert member is offset from the longitudinal axis of the guide passage and parallel thereto. If the cone angle of the sharpened point is able to be steplessly variable, the rotary axis of the insert member and the longitudinal axis of the guide passage include an acute angle between one another. If is within the scope of the present invention to make provision for only one or both of the aforementioned adjustments in a single lead sharpener. This will become apparent from the following description of examples of the invention illustrated in the accompanying drawings, wherein:

FIG, 1 is a sectional elevation of a lead sharpener in which only the spacing between the axis of the lead and the operating face of the milling cutter is variable, the angle of the point of the lead remaining constant;

In all the figures of the drawings, the same reference numerals are used for corresponding integers.

Figure 1:
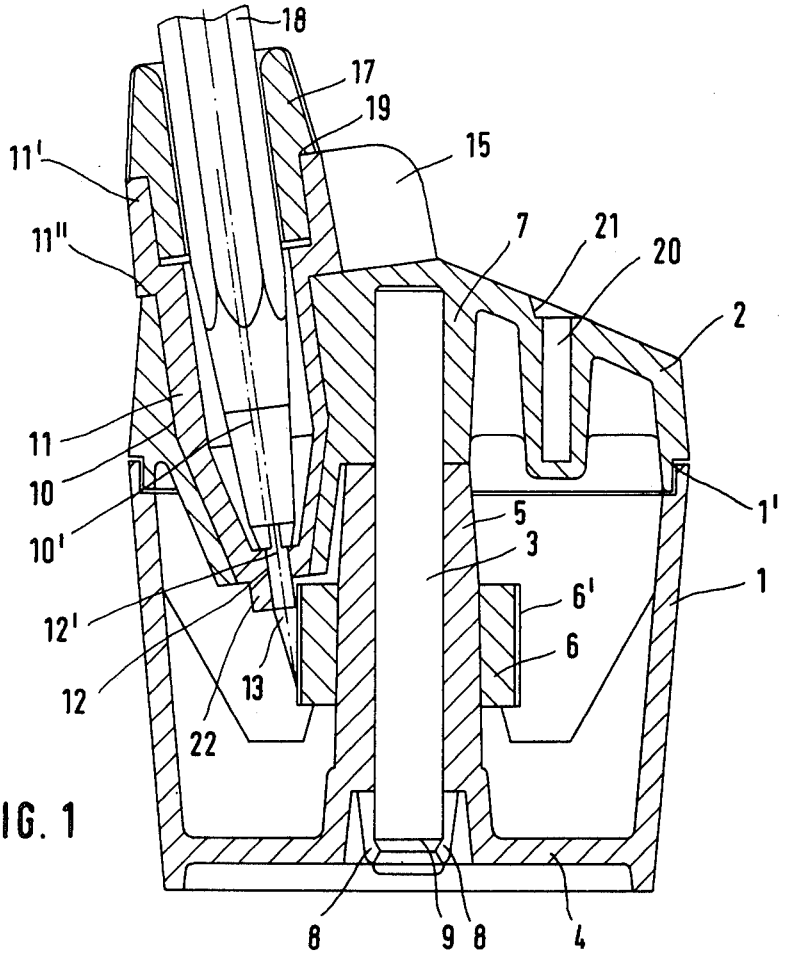

The housing of the sharpener is formed by a lower portion 1 and an upper portion 2, which may be plastics mouldings and are rotatable relatively to one another. For this purpose, the upper portion 2 is seated on the upper end of a shaft 3 which is preferably of metal and which is inserted from the top of a guide sleeve 5 which is moulded to the upper surface of the base 4 of the lower housing portion 1 and on which a milling cutter 6 is mounted against rotation. The upper portion 2 is fixed to the upper end of the part of the shaft 3 that projects from the top of the guide sleeve 5. For this purpose the upper end of the shaft 3 may be pressed, stuck or injected into a sleeve 7 which is formed on the underside of the upper housing portion 2 and the lower end of which extends almost up to the upper end of the guide sleeve 5 that is at the level of the mouth 1' of the lower housing portion 1. By means of the guide sleeve 5 and the sleeve 7, the shaft 3 is protected against soiling by dust produced during sharpening of the lead. The rotary shaft 3 is axially positioned by means of clips 8 provided on the underside of the base 4 in the vicinity of the lower aperture in the sleeve 5. These clips are preferably in the form of tongues moulded integrally with the base 4 and engageable in a circumferential depression 9 at the lower end of the shaft 3. In this way the upper housing portion 2 can be readily removed from the lower portion for the purpose of emptying lead shavings and dust that have accumulated in the lower housing portion after the sharpener has been used for some time.

In all of the illustrated embodiments of the invention, the upper housing portion 2 is provided with a hole 10 which is eccentric with respect to the shaft 3. This hole serves to receive insert members 11 and/or 23 which are rotatable within the hole. The axis of rotation of the or each insert member in the various embodiments assumes a different spatial position from the longitudinal axis of a guide passage 12 which is formed in the front end of the insert member and into which the lead 13 that is to be sharpened is introduced. The different spatial positioning will be described in more detail hereinafter.

Figure 2:
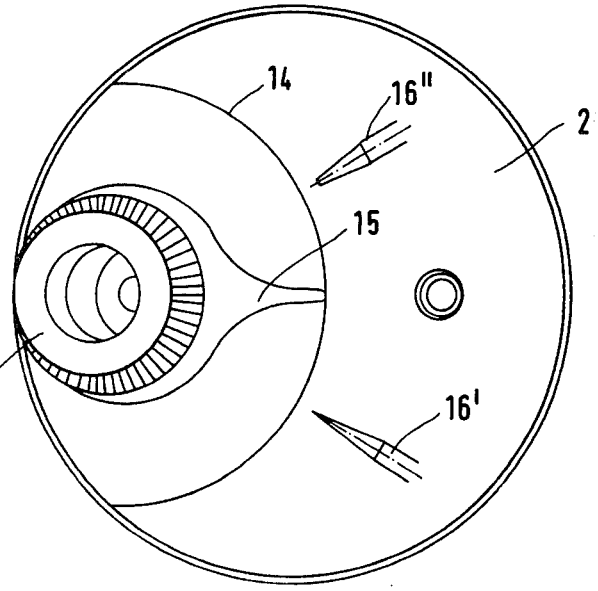
FIG. 2 is a plan view of the FIG. 1 sharpener.

The top of the upper housing portion 2 is inclined to give it a cross-sectional shape resembling a ridged roof, the ridge line being indicated at 14 in FIG. 2. By reason of this configuration or bevelling, the insert members 11 and/or 23 and consequently the guide passage for the lead is given a desired inclination to the operating face 6' of the milling cutter 6.

As will be evident from FIG. 1, the rotary axis 10' of the insert member 11 coincides with the longitudinal axis of the hole 10 and is offset from and parallel to the longitudinal axis 12' of the guide passage 12. In practice, it will generally be sufficient if the axes in question are offset by a distance of about 1 to 3 mm.

If in the FIG. 1 embodiment the insert 11 is rotated then the spacing between the axis of the lead and the operating face 6' of the milling cutter is varied. The closer the end of the lead to be sharpened is positioned to the operating face of the milling cutter, the finner will be the point of the lead produced by turning the upper housing portion 2 relatively to the lower portion 1.

To turn the insert member 11 and thereby change the spacing between the axis of the lead and the operating face of the milling cutter, the FIGS. 1 and 2 embodiment makes provision for a handle 15 which is provided on a portion 11' of the insert 11 that projects upwardly out of the hole 10 and that is provided with a shoulder 11" supported by the top of the upper housing portion 2. This handle 15 also serves as an indicator for the direction in which the insert member 11 has to be turned to achieve a finer or coarser point on the lead. For this purpose, the handle 15 acts as a pointer for co-operating with appropriate markings 16' and 16" provided at the top of the upper housing portion 2.

It will be evident from the drawings that in order to bring about the different spatial position of the axis 12' of the guide passage 12 from the rotary axis of the or each insert member, the wall thickness of the or each insert member increases in a circumferential direction from one position to an angularly displaced other position. Since all that matters is that the rotary axis of the or each insert member be appropriately positioned relatively to the longitudinal axis 12' of the guide passage 12 and thus relatively to the longitudinal axis of the lead 13, the aforementioned change in wall thickness may be restricted to certain regions of the or each insert, i.e. the change in wall thickness need not be provided over the entire length of the insert or inserts.

In FIG. 1, the insert member 11 is in a rotary position for resulting in a very fine point on the lead. If one were to turn the insert member out of this position so that a portion of larger wall thickness of the insert member 11 comes to lie between the axis 10' and the axis of the milling cutter 6, then a larger spacing is necessarily produced between the axis 12' and the operating face 6' of the milling cutter and consequently a less slender point will be produced on the lead. Such rotation of the insert member 11 also serves to compensate for wear of the lead guide after prolonged use of the sharpener, wherby a fine point can always be achieved by means of the sharpener according to the invention. Another advantage is that, by reason of the eccentricity between the axes 12' and 10', the tip 13 of the lead can, by turning the insert member, be swung away from the operating face 6' of the milling cutter so that, if the tip has been accidentally broken off and jammed against the operating face, it can be readily released without having to take the sharpener apart.

To support the tip of the lead during the sharpening operation, the lower end of the insert member 11 is provided with a backing member 22 which extends over only a portion of the periphery of the lead so as not to impede full insertion of the lead through the guide passage.

A guide tube 17 for a lead holder 18 such as a clutch pencil or propelling pencil is inserted in the upper end of the insert member 11 and is preferably exchangeable. In this way the guide for the lead holder can be adapted to different diameters of clutch pencils or propelling pencils. The guide tube 17 has a shoulder 19 supported by the insert member 11.

Figure 3:
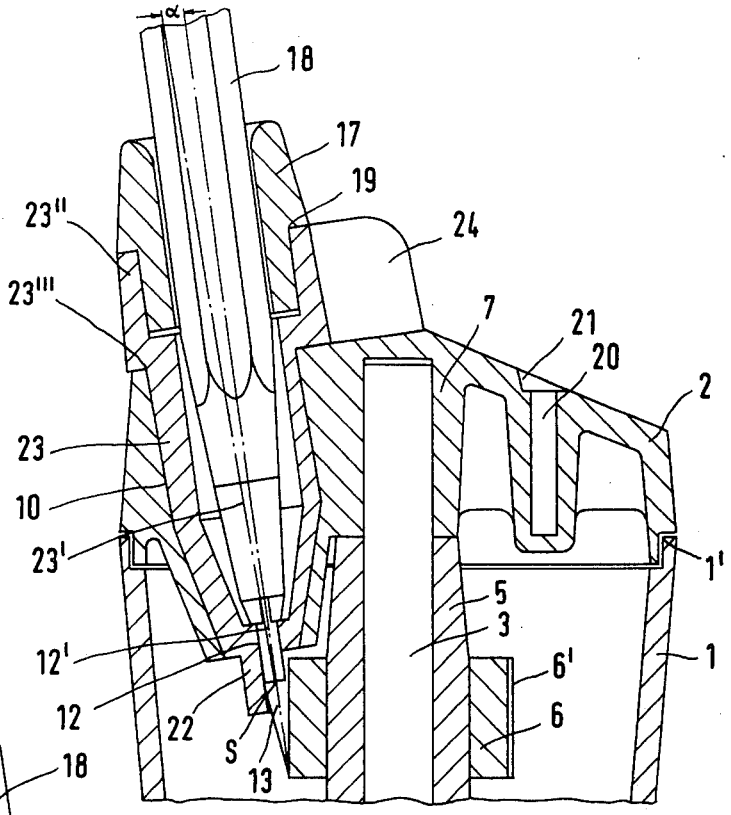
FIG. 3 is a fragmentary sectional elevation of a sharpener in which, upon varying the spacing between the axis of the lead and the operating face of the milling cutter, the acute angle included by same is necessarily also varied.
Figure 4:
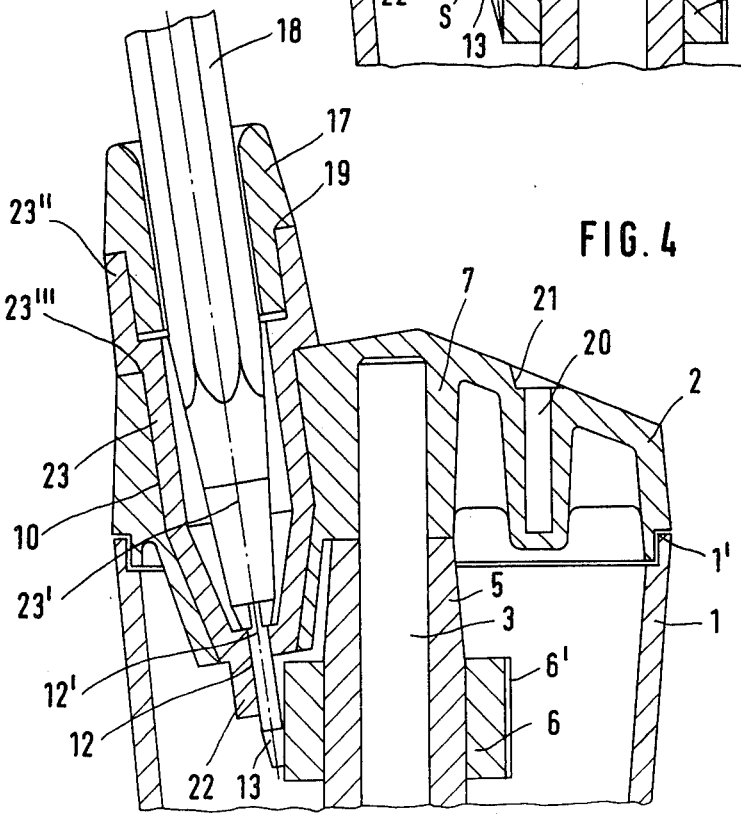
FIG. 4 is a view similar to that of FIG. 3 showing the longitudinal axis of the guide passage and the lead after the insert member has been turned through 90°.

In the embodiment of FIGS. 3 and 4, the insert 23 rotatable in the hole 10 has a rotary axis 23' extending at an acute angle $\alpha$ to the longitudinal axis 12' of the guide passage 12, their intersection being at a point S in the vicinity of the end of the lead to be sharpened, whereby the length of the arc along which the end of the lead moves upon actuation of the rotatable insert member is kept as short as possible so as to provide a space-saving arrangement. In practice, it will generally be sufficient if the aforementioned angle $\alpha$ is between about 1° and 5°, the inclination of the rotary axis of the insert member 23 to the operating face 6' of the milling cutter being between about 8° and 15°.

If the insert member 23 is turned through 90° out of the FIG. 3 position by means of the handle 24 provided on the insert member, then the end of the lead to be sharpened is brought to a position such as that shown in FIG. 4, in which the axis of the lead and the operating face 6' of the milling cutter 6 include a larger angle than in FIG. 3. The length of the tip of the lead that can be sharpened is thereby changed and this will be evident from a comparison of FIGS. 3 and 4. The larger the angle set between the axis 12' and the operating face 6', the shorter will be the length of the sharpened lead tip and the larger will be the angle of the conically sharpened point (vertex angle).

The portion 23" of the insert member 23 projecting from the hole 10 in the upper housing portion 2 is formed with a shoulder 23"' by means of which the insert member is supported on the upper face of the housing portion 2. The aforementioned handle 15 is provided on this portion 23".

FIG. 3 also shows that to bring about the different positions of the guide passage axis 12' or the axis of the lead 13 with respect to the rotary axis 23' of the insert member 23, the thickness of the wall of the insert member 23 (including its lower end in which the guide passage 12 is formed) is increased from one circumferential position to an angularly displaced different position. This ensures that the two axes 23' and 12' will not coincide but extend at an acute angle to one another by appropriately positioning the guide passage 12.

Figure 5:
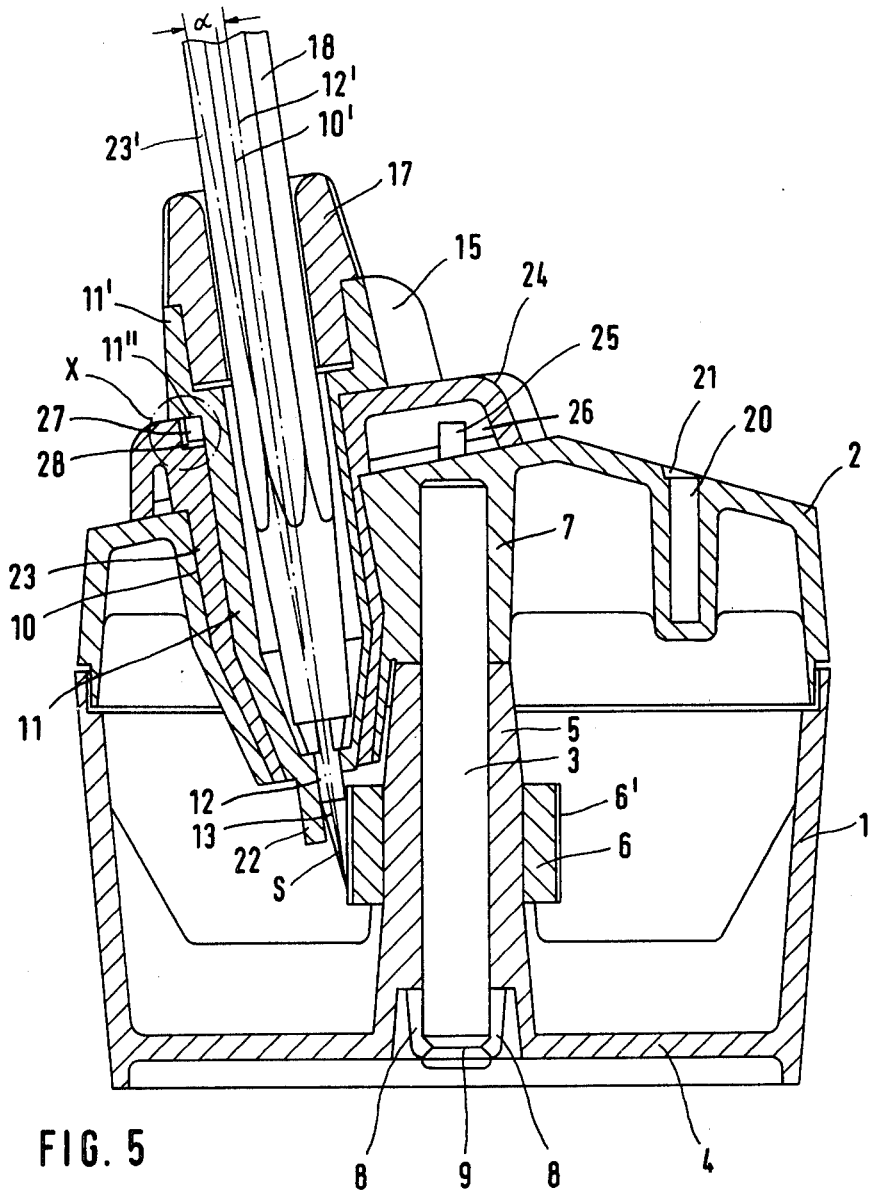
FIG. 5 is a sectional elevation of a lead sharpener in which the features of the FIGS. 1, 2 and 3, 4 embodiments are combined.
Figure 6:
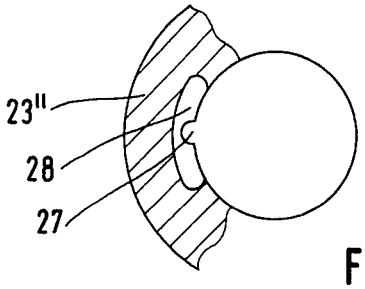
FIG. 6 is an enlarged section taken perpendicular to the longitudinal axis of the lead holder of that part of FIG. 5 that is shown in a circle.
Figure 7:
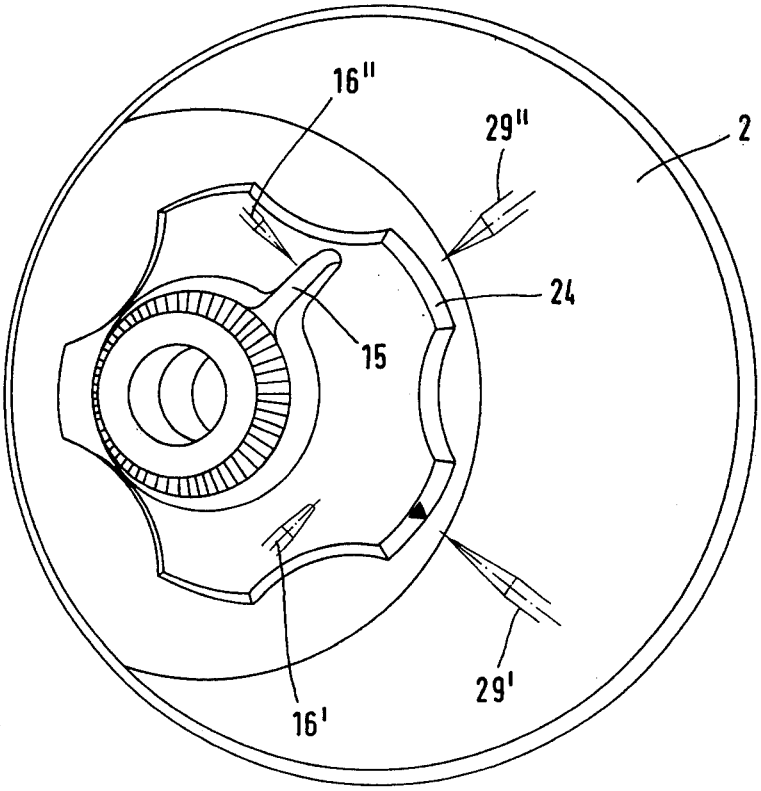
FIG. 7 is a plan view of the FIG. 5 embodiment.

Referring to the embodiment of FIGS. 5 to 7, the position of the axis 12' of the guide passage is variable with respect to the operating face 6' of the milling cutter 6 in two respects. Firstly, the angle between the axis 12' and the operating face 6' can be changed so as to adjust the cone angle of the lead point to be sharpened. Secondly, the spacing between the axis 12' and the operating face 6', which are at a constant angle to one another, can be changed in order to control the sharpness of the lead point. These two adjustments are achieved by providing two internested rotatable insert members 11 and 23 in the hole 10 of the upper housing portion 2, the construction and arrangement of these insert members being such that the rotary axis 10' of the insert member 11 is offset from the longitudinal axis 12' of the guide passage 12 by a certain amount (but parallel thereto) and the rotary axis 23' of the insert member 23 extends at an acute angle $\alpha$ to the axis 12' of the guide passage 12. This positioning of the rotary axes 10' and 23' with respect to the axis 12' is again achieved by a circumferential change in the wall thicknesses of the insert members 11 and 23 resulting in the desired location of these insert members with respect to each other and with respect to the axis 12'. Since the guide tube 17 for the lead holder 18 is aligned with respect to the rotary insert members, the axis 12' coincides with the longitudinal axis of the lead holder and thus with the longitudinal axis of the lead.

In the embodiment as illustrated in FIG. 5, the upper end of the inner insert member 11 projects above the upper end of the outer insert member 23, the portions 11' and 23'' of the insert members being each provided with a handle 15 and 24, respectively, by means of which the insert members can be turned. To limit the rotation of the insert member 23, the top of the upper housing portion 2 is formed with a pin 25 which co-operates with two abutment ribs 26 projecting from the underside of the handle 24. As will be evident from FIG. 7, the handle 24 is in this case in the form of a knob provided with finger depressions at its periphery. The ribs 26 are disposed at a spacing from one another and this spacing determines the angle through which the insert member 23 can be rotated.

The details of means for limiting the rotation of the insert member 11 are evident from FIG. 6. A depending cam 27 is formed on the shoulder 11'' of the portion 11' of the insert member 11. This can engages in a groove 28 formed in the top of the portion 23'' of the insert member or in the handle 24. The groove 28 is arcuate and extends over about a quarter of the circumference of a circle; its ends form abutments for the cam 27.

The handles 15 and 24 for the insert members 11 and 23, respectively, are superposed, the handle 24 projecting radially beyond the handle 15.

On the top of the handle 24 markings 16', 16'' are provided to co-operate with the handle 15 and indicate to the user in which direction the handle 15 and thus the insert member 11 has to be turned in order to obtain a finer or coarser point on the lead, depending on how sharp the point is to be. Similarly, the top of the upper housing portion 2 is provided with markings 29', 29'' as an indication for the direction in which the handle 24 for the insert member 23 has to be rotated to achieve a larger or smaller cone angle at the tip of the sharpened lead.

Depending from the top of the upper housing portion 2 there is a formation defining a blind hole 20 with a countersunk portion 21 at its mouth. Before the lead is sharpened, the lead holder 18 is placed in the countersunk portion 21 and the lead 13 is projected from the holder until it extends to the bottom of the hole 20. The projecting portion of the lead will then be of a length suitable for insertion through the guide passage 12 to co-operate with the milling cutter 6. Accordingly, the blind hole 20 serves as means for setting the length of the tip of the lead to be sharpened.

I claim:

1. A lead sharpener comprising a housing formed by lower and upper housing portions which are relatively rotatable about a first rotary axis, a guide passage provided in said housing for introducing a lead to be sharpened, said passage being accentric with respect to said first rotary axis, a milling cutter in said housing, said cutter having an operating face extending at an acute angle to the longitudinal axis of said passage, a hole in said upper portion, a hollow insert member rotatable in said hole about a secondary rotary axis, said second rotary axis being offset from and parallel to said longitudinal axis.

2. The sharpener defined in claim 1, wherein said second rotary axis is offset by substantially 1mm to 3mm from said longitudinal axis.

3. The sharpener defined in claim 1, wherein a first circumferential wall portion along at least part of the length of said hollow insert member increases in thickness with respect to a second circumferential wall portion that is angularly offset with respect to the first circumferential wall portion.

4. The sharpener defined in claim 1, including a replaceable guide tube for a lead holder, said guide tube being disposed in the upper end of said insert member.

5. A lead sharpener comprising a housing formed by lower and upper housing portions which are relatively rotatable about a first rotary axis, a guide passage provided in said housing for introducing a lead to be sharpened, said passage being eccentric with respect to said first rotary axis, a milling cutter in said housing, said cutter having an operating face extending at an acute angle to the longitudinal axis of said passage, a hole in said upper portion, an outer insert member disposed in said hole, an inner insert member disposed in said outer insert member, one said insert being being rotatable about a second rotary axis that is offset from and parallel to said longitudinal axis and the other said insert member being rotatable about a third rotary axis extending at an acute angle to said longitudinal axis, said insert members being independently rotatable.

6. The sharpener defined in claim 3, wherein said third rotary axis and said longitudinal axis include an angle of substantially 1° to 5° between each other.

7. The sharpener defined in claim 5, wherein the upper end of said inner insert member projects beyond the upper end of said outer insert member and said upper ends are provided with respective handles for rotating said insert members, said handles being superposed.

* * * * *

UNITED STATES PATENT AND TRADEMARK OFFICE

CERTIFICATE OF CORRECTION

PATENT NO. : 4,124,048

DATED : November 7, 1978

INVENTOR(S) : ERNST FISCHER

It is certified that error appears in the above-identified patent and that said Letters Patent are hereby corrected as shown below:

Column 6, line 46, change "3" to -- 5 --.

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*